US011549245B2

(12) United States Patent
Snyder, Jr. et al.

(10) Patent No.: US 11,549,245 B2
(45) **Date of Patent: *Jan. 10, 2023**

(54) METHODS AND SYSTEMS FOR PLUMBING FIXTURE INSTALLATIONS

(71) Applicant: CONIVATE IP, INC., Manasquan, NJ (US)

(72) Inventors: Robert B. Snyder, Jr., Manasquan, NJ (US); Michael Richard Sheridan, Howell, NJ (US)

(73) Assignee: Conivate IP, Inc., Manasquan, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/374,254

(22) Filed: Jul. 13, 2021

(65) Prior Publication Data

US 2022/0112702 A1 Apr. 14, 2022

Related U.S. Application Data

(63) Continuation of application No. 17/069,839, filed on Oct. 13, 2020, now Pat. No. 11,060,268.

(51) Int. Cl.
*E03C 1/122* (2006.01)
*E04B 2/58* (2006.01)

(52) U.S. Cl.
CPC ..... *E03C 1/122* (2013.01); *E04B 2/58* (2013.01)

(58) Field of Classification Search
CPC . E03C 1/122; E03C 1/322; E04B 2/58; E04B 1/34869; E03D 11/143
USPC ..... 4/695–696, 679
See application file for complete search history.

(56) References Cited

U.S. PATENT DOCUMENTS

| | | | | |
|---|---|---|---|---|
| 3,933,400 | A * | 1/1976 | Helgeson | A47B 77/04 312/200 |
| 4,512,261 | A | 4/1985 | Horger | |
| 4,526,218 | A | 7/1985 | Banner | |
| 4,527,484 | A | 7/1985 | Veith | |
| 5,355,804 | A | 10/1994 | Garcia | |
| 5,588,614 | A | 12/1996 | Takada | |
| 5,788,309 | A * | 8/1998 | Emery | B60P 7/15 410/152 |
| 6,102,157 | A * | 8/2000 | Goldbach | B24C 3/065 451/75 |
| 6,186,273 | B1 * | 2/2001 | Goldbach | E04G 1/20 182/128 |
| 11,060,268 | B1 * | 7/2021 | Snyder, Jr. | E03C 1/122 |
| 2007/0125404 | A1 | 6/2007 | Davis | |
| 2007/0234927 | A1 | 10/2007 | Beers | |
| 2008/0226434 | A1 | 9/2008 | Smith | |
| 2008/0257445 | A1 | 10/2008 | Subacchi | |
| 2013/0206494 | A1 | 8/2013 | Hedlund | |
| 2014/0209382 | A1 | 7/2014 | Smith | |
| 2017/0119413 | A1 | 5/2017 | Romo | |
| 2017/0128769 | A1 | 5/2017 | Long | |
| 2017/0143566 | A1 | 5/2017 | Elku | |

(Continued)

*Primary Examiner* — Lori L Baker
(74) *Attorney, Agent, or Firm* — Kelley Drye & Warren LLP

(57) ABSTRACT

A modular plumbing system having one or more carriers each attached to a carrier mount that may be joined to one or more base rails. The modular plumbing system may be transported to a construction site fully assembled and ready to be installed by anchoring the plumbing system to a floor and connecting plumbing lines within the plumbing system to existing plumbing lines.

20 Claims, 15 Drawing Sheets

(56) References Cited

U.S. PATENT DOCUMENTS

| | | | |
|---|---|---|---|
| 2017/0191516 | A1 | 7/2017 | Griffith |
| 2017/0246065 | A1 | 8/2017 | Connell |
| 2018/0153752 | A1 | 6/2018 | Kostic |
| 2019/0082859 | A1 | 3/2019 | Marton |
| 2020/0237105 | A1 | 7/2020 | Eskridge, III |
| 2020/0260880 | A1 | 8/2020 | Nelson |
| 2020/0284025 | A1 | 9/2020 | Le Roux |
| 2020/0324351 | A1 | 10/2020 | Ribaudo |
| 2020/0329879 | A1 | 10/2020 | Brichet |
| 2020/0330301 | A1 | 10/2020 | Zerhusen |

* cited by examiner

METHODS AND SYSTEMS FOR PLUMBING FIXTURE INSTALLATIONS

CROSS-REFERENCE TO RELATED APPLICATIONS

This application is a continuation of U.S. patent application Ser. No. 17/069,839, filed on Oct. 13, 2020. The entire contents of that application are incorporated herein by reference.

BACKGROUND OF THE INVENTION

Wall mounted bathroom fixtures, such as toilets and sinks that have no external contact with the floor, are called "off-the-floor" or "wall-hung" plumbing fixtures. Fixtures so mounted are typically supported on supports (i.e., carriers) concealed behind the wall to which they are attached. A carrier, typically made from cast iron or steel, may connect to a fixture by means of a face plate. The face plate may be joined to a base support that is anchored to the floor, thereby transmitting to the floor the load of the fixture.

During construction of a commercial restroom, to install wall-hung toilets, the location of each toilet and its associated carrier are first determined. The associated plumbing, including pipes for fresh water and sewage water, is measured, cut, and positioned. Each carrier assembly may then be anchored to the floor. Carrier assemblies are typically anchored to the floor at three or four points. Bolts may be inserted into holes in the floor at each anchor point, and the carrier assemblies may be secured to the bolts. Also installed are any required support for the pipes.

Installing carriers and related plumbing for wall-hung toilets, particularly in commercial restrooms having multiple toilets, often creates substantial delays during the construction process. Carpenters and other persons working to construct the restrooms need to allow significant time—sometimes one or more days—for the plumbing to be installed before the finished walls covering the plumbing may be constructed.

In view of these prior devices, it has been an object of the present invention to devise a toilet carrier that may be installed at the time the wall is built and that will allow the proper toilet to be attached thereto at a later time.

SUMMARY OF THE INVENTION

The present invention is directed to improved methods and systems for plumbing installations.

It is an object of the present invention to provide a modular plumbing assembly that may be transported to a construction site fully assembled and ready to be installed by anchoring the plumbing assembly to a floor and connecting plumbing lines within the plumbing assembly to existing plumbing lines.

It is a further objection of the present invention to provide a plumbing assembly having one or more carriers each attached to a carrier mount that may be joined to base rails.

It is also an object of the present invention to provide a plumbing assembly having a plurality of carriers and that may be anchored to a floor using fewer attachment points than would be required if each carrier were attached directly to the floor.

Numerous variations may be practiced in the preferred embodiment.

BRIEF DESCRIPTION OF THE DRAWINGS

A further understanding of the invention can be obtained by reference to exemplary embodiments set forth in the illustrations of the accompanying drawings. Although the illustrated embodiments are merely exemplary of systems, methods, and apparatuses for carrying out the invention, both the organization and method of operation of the invention, in general, together with further objectives and advantages thereof, may be more easily understood by reference to the drawings and the following description. Like reference numbers generally refer to like features (e.g., functionally similar and/or structurally similar elements).

The drawings are not necessarily depicted to scale; in some instances, various aspects of the subject matter disclosed herein may be shown exaggerated or enlarged in the drawings to facilitate an understanding of different features. Also, the drawings are not intended to limit the scope of this invention, which is set forth with particularity in the claims as appended hereto or as subsequently amended, but merely to clarify and exemplify the invention.

DETAILED DESCRIPTION OF THE INVENTION

The invention may be understood more readily by reference to the following detailed descriptions of embodiments of the invention. However, techniques, systems, and operating structures in accordance with the invention may be embodied in a wide variety of forms and modes, some of which may be quite different from those in the disclosed embodiments. Also, the features and elements disclosed herein may be combined to form various combinations without exclusivity, unless expressly stated otherwise. Consequently, the specific structural and functional details disclosed herein are merely representative. Yet, in that regard, they are deemed to afford the best embodiments for purposes of disclosure and to provide a basis for the claims herein, which define the scope of the invention. It should also be noted that, as used in the specification and the appended claims, the singular forms "a", "an", and "the" include plural referents unless the context clearly indicates otherwise.

Use of the term "exemplary" means illustrative or by way of example, and any reference herein to "the invention" is not intended to restrict or limit the invention to the exact features or steps of any one or more of the exemplary embodiments disclosed in the present specification. Also, repeated use of the phrase "in one embodiment," "in an exemplary embodiment," or similar phrases do not necessarily refer to the same embodiment, although they may. It is also noted that terms like "preferably," "commonly," and "typically," are not used herein to limit the scope of the claimed invention or to imply that certain features are critical, essential, or even important to the structure or function of the claimed invention. Rather, those terms are merely intended to highlight alternative or additional features that may or may not be used in a particular embodiment of the present invention.

For exemplary methods or processes of the invention, the sequence and/or arrangement of steps described herein are illustrative and not restrictive. Accordingly, it should be understood that, although steps of various processes or methods may be shown and described as being in a sequence or temporal arrangement, the steps of any such processes or methods are not limited to being carried out in any particular sequence or arrangement, absent an indication otherwise. Indeed, the steps in such processes or methods generally may be carried out in various different sequences and arrangements while still falling within the scope of the present invention.

Figure 1:
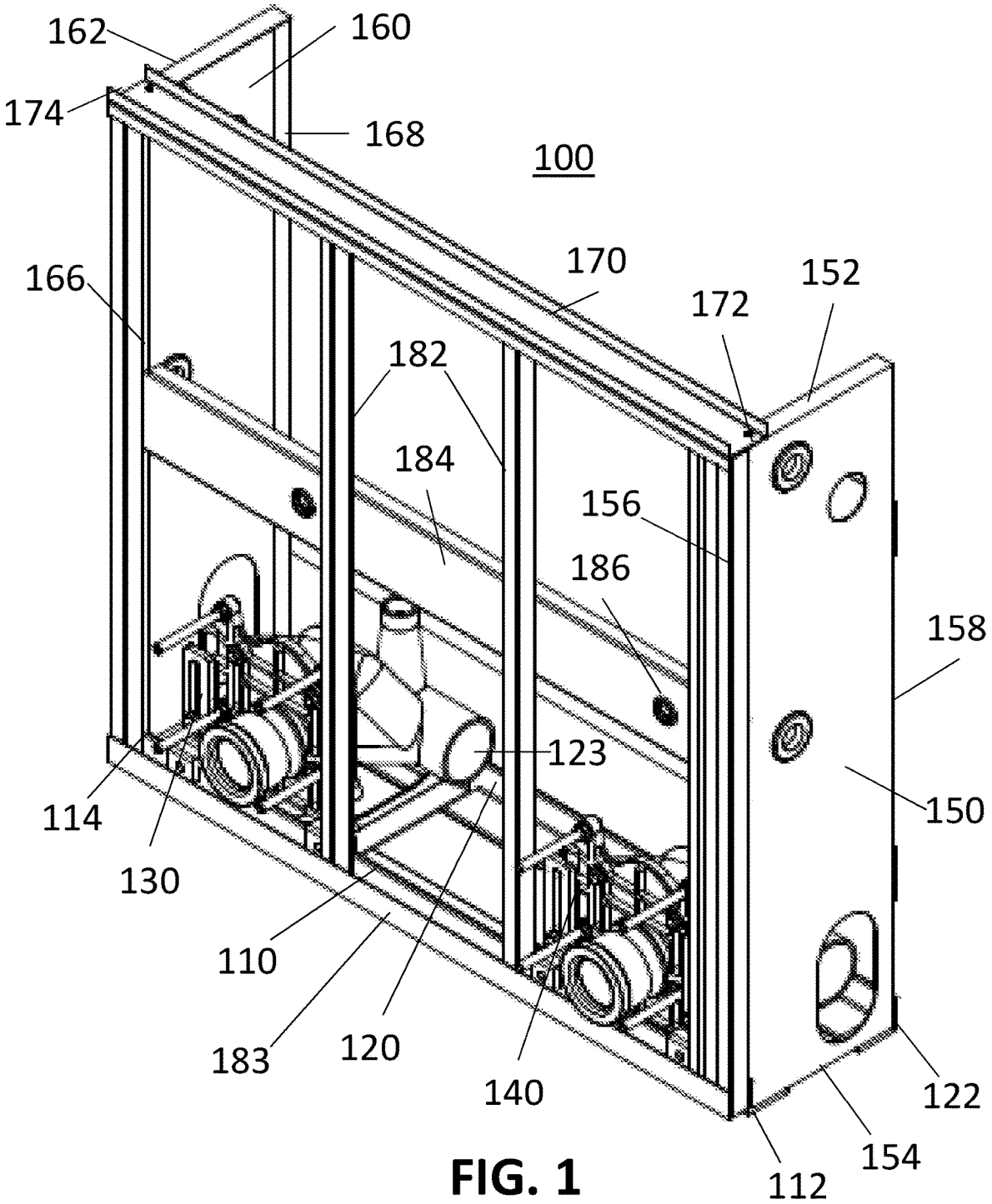
FIG. 1 depicts a perspective view of an exemplary embodiment of the present invention.

FIG. 1 depicts a plumbing assembly (100) in accordance with the present invention. At the bottom of plumbing assembly (100) may be a first base rail (110) extending longitudinally from a first end (112) to a second end (114) and a second base rail (120) extending longitudinally from a first end (122) to a second end (not shown). Preferably first base rail (110) and second base rail (120) are parallel or substantially parallel to each other.

A first carrier subassembly (130) may be mounted to first base rail (110) and second base rail (120). As shown in FIG. 1, a second carrier subassembly (140) may also be mounted to first base rail (110) and second base rail (120). In accordance with the present invention, plumbing assembly (100) may have three carrier subassemblies, four carrier subassemblies or any number of carrier subassemblies mounted to first base rail (110) and second base rail (120).

A first bulk head (150) may be attached to first base rail (110) and/or to second base rail (120). First bulkhead (150) preferably has a rectangular shape, including a top edge (152), a bottom edge (154), a first side edge (156), and a second side edge (158). Bottom edge (154) of first bulkhead (150) may be attached to first base rail (110) at or near first end (112) of first base rail (110). Bottom edge (154) of first bulkhead (150) may also be attached to second base rail (120) at or near first end (122) of second base rail (120). A second bulkhead (160) may also be attached to first base rail (110) and/or to second base rail (120). Second bulkhead (150) also preferably has a rectangular shape, including a top edge (162), a bottom edge (164, not shown), a first side edge (166), and a second side edge (168).

A first top rail (170) may be attached to and span between first bulkhead (150) and second bulkhead (160). First top rail may extend longitudinally from a first end (172) to a second end (174). Preferably, first end (172) of first top rail (170) may be attached to top edge (152) of first bulkhead (150) and second end (174) of first top rail (170) may be attached to top edge (162) of second bulkhead (160). Alternatively, first end (172) of first top rail (170) may be attached to first side edge (156) of first bulkhead (150) and second end (174) of first top rail (170) may be attached to first side edge (166) of second bulkhead (160).

Plumbing assembly (100) may further have a second top rail, third top rail, or any number of top rails extending from first bulkhead (150) to second bulkhead (160). Each top rail may extend longitudinally from a first end to a second end. Preferably the first end of each top rail may be attached to the top edge (152) and/or second side edge (158) of bulkhead (150) and the second end of each top rail may be attached to the top edge (162) and/or second side edge (168) of second bulkhead (160).

Plumbing assembly (100) may further include plumbing lines, such as fresh water plumbing lines and waste water plumbing lines (123) attached to the carrier subassemblies. To the extent that plumbing assembly (100) has more than one carrier subassembly, plumbing assembly (100) may include plumbing lines between carrier assemblies.

Plumbing assembly (100) may further include additional frame elements and supports. For example, vertical frame elements (182), outer base supports (183), and one or more side rails (184) may be used to provide additional structural support to plumbing assembly (100). One or more side rails (184) may include one or more apertures (186) to allow access for and/or to provide physical support for one or more plumbing pipes, such as one or more fresh water lines.

Figure 2A:
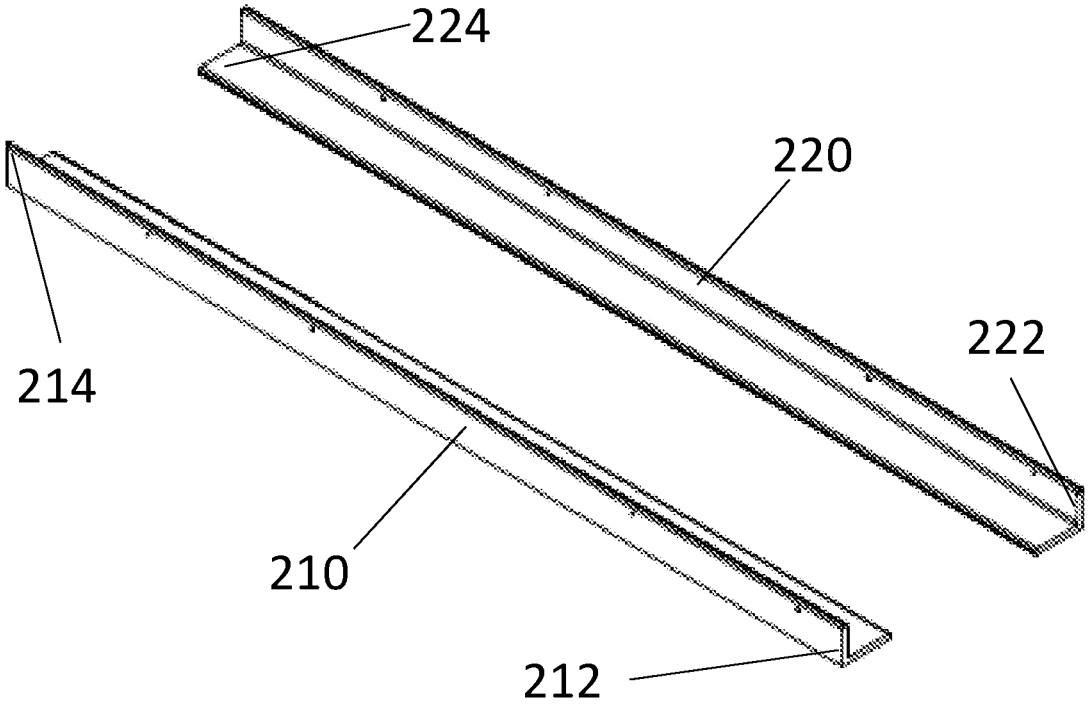
FIG. 2A depicts exemplary base rails in accordance with the present inventions.

FIG. 2A depicts an exemplary first base rail (210) extending longitudinally from a first end (212) to a second end (214), and an exemplary second base rail (220) extending longitudinally from a first end (222) to a second end (224). As shown in FIG. 2, second base rail (220) may be aligned parallel to or substantially parallel to first base rail (210).

Each of first base rail (210) and second base rail (220) may have a constant cross-section from first end (212, 222) to second end (214, 224). Alternatively, first base rail (210) and/or second base rail (220) may have a cross-section that is not constant from first end (212, 222) to second end (214, 224). Also, first base rail (210) may have the same cross-section as second base rail (220). Alternatively, first base rail (210) and second base rail (220) may have different cross-sections.

Figure 2B:
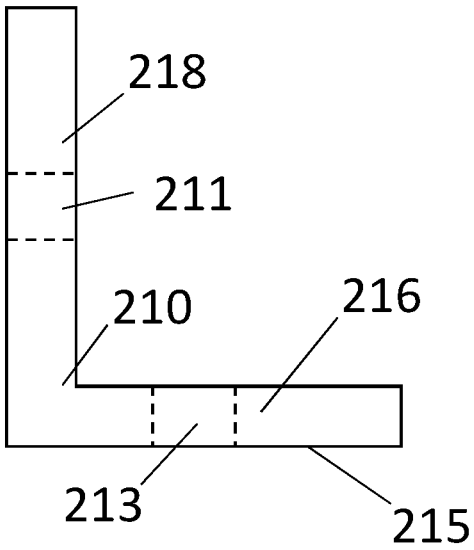
FIGS. 2B-2F depict exemplary base rail cross-sections in accordance with the present invention.
Figure 2C:
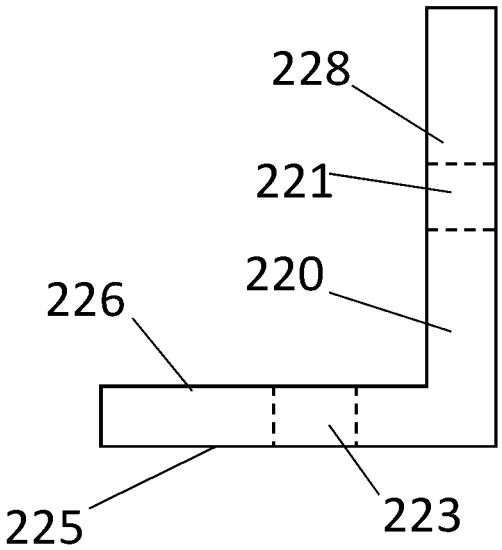

The cross-sections for first base rail (210) and second base rail (220) may be selected from various forms. As shown in FIGS. 2B and 2C, first base rail (210) and second base rail (220) each may have an L-shaped cross-section having a horizontal portion (216, 226) joined to a vertical portion (218, 228) extending upward from one edge of the flat horizontal portion (216, 226). Preferably each horizontal portion (216, 226) has a flat or substantially flat bottom surface (215, 225) intended to be aligned with and placed on top of a flat floor surface. First base rail (210) and second base rail (220) may be oriented so that their cross-sections are mirror images of each other across a vertical plain situated between and orthogonal to the longitudinal axis of first base rail (210) and second base rail (220).

Vertical portion (218) of first base rail (210) and/or vertical portion (228) of second base rail (220) may have one or more apertures (211, 221) that may be used to join one or more carrier subassemblies to first base rail (210) and/or second base rail (220) as discussed further below. Additionally or alternatively, horizontal portion (216) of first base rail (210) and/or horizontal portion (226) of second base rail (220) may have one or more apertures (213, 223) that may be used to attached first base rail (210) and/or second base rail (220) to a floor by, for example, inserting a joining member such as a bolt or screw through aperture (213, 223)

and fixing the base rail (210, 220) to the joining member with, for example, a nut screwed onto the joining member.

Figure 2D:
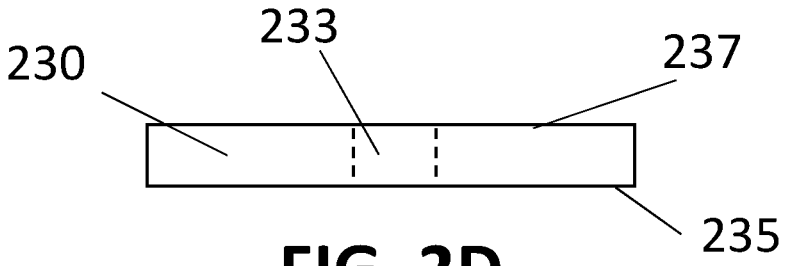
Figure 2E:
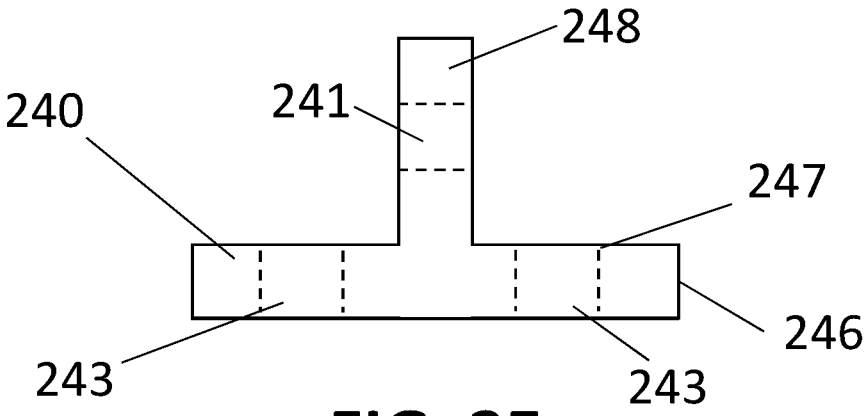
Figure 2F:
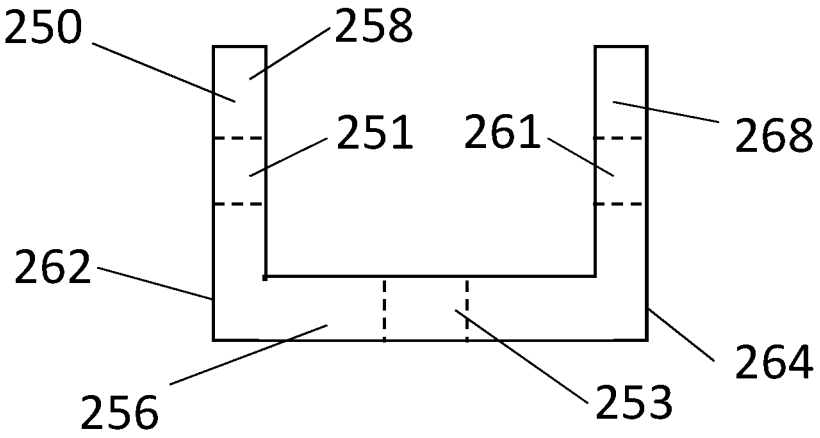

As shown in FIG. 2D, each base rail (230) may be a flat or substantially flat slat having a rectangular cross-section with a substantially flat bottom surface (235) and a substantially flat top surface (237). Alternatively, as shown in FIG. 2E, each base rail (240) may have an inverted T-shaped cross-section having a flat horizontal portion (246) joined to a vertical portion (248) extending upward from the top surface (247) of the horizontal portion (246), preferably at or near the center line of the horizontal portion (246). Alternatively, as shown in FIG. 2F, each base rail (250) may have a U-shaped cross-section having a flat horizontal portion (256) joined to a first vertical portion (258) extending upward from a first edge (262) of the flat horizontal portion (256) and a second vertical portion (268) extending upward from a second edge of the flat horizontal portion (264). Each base rail (230, 240, 250) may have one or more apertures (233, 243, 253) that may be used to attach the base rail to a floor as described above for first base rail (210) and second base rail (220). Additionally or alternative, vertical portions (248, 258, 268) of base rails (240, 250) may have one or more apertures (241, 251, 261) that may be used to join one or more carrier subassemblies to the base rail.

Figure 3A:
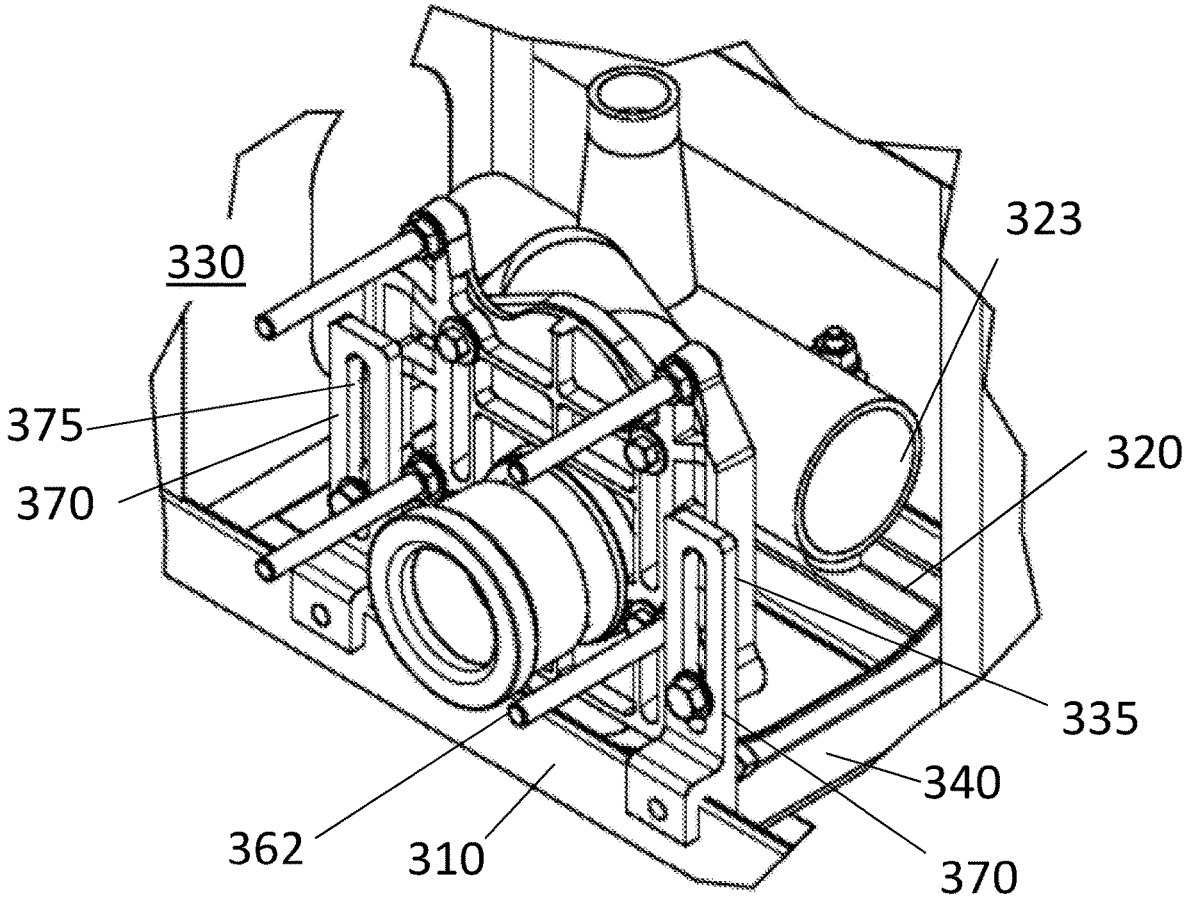
FIG. 3A depicts a perspective view of a carrier subassembly in accordance with the present invention.
Figure 3B:
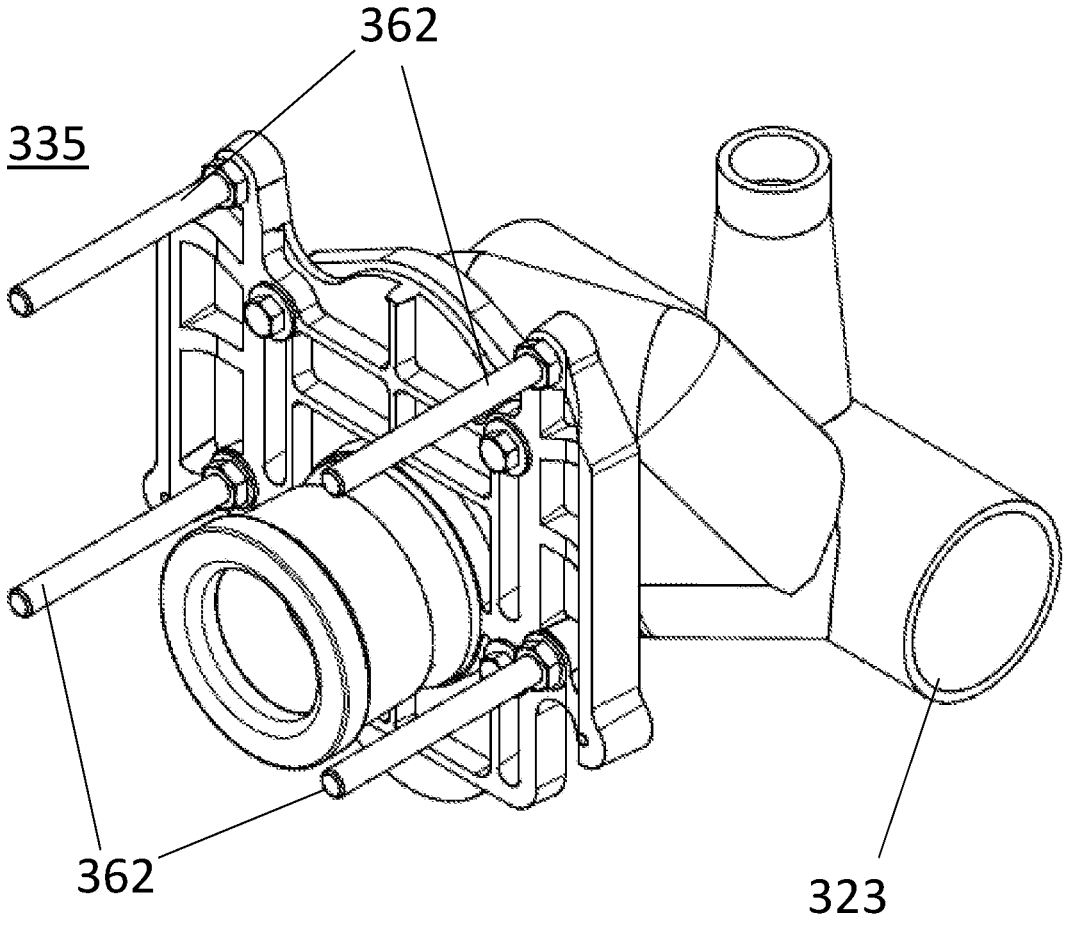
FIG. 3B depicts a carrier.
Figure 4:
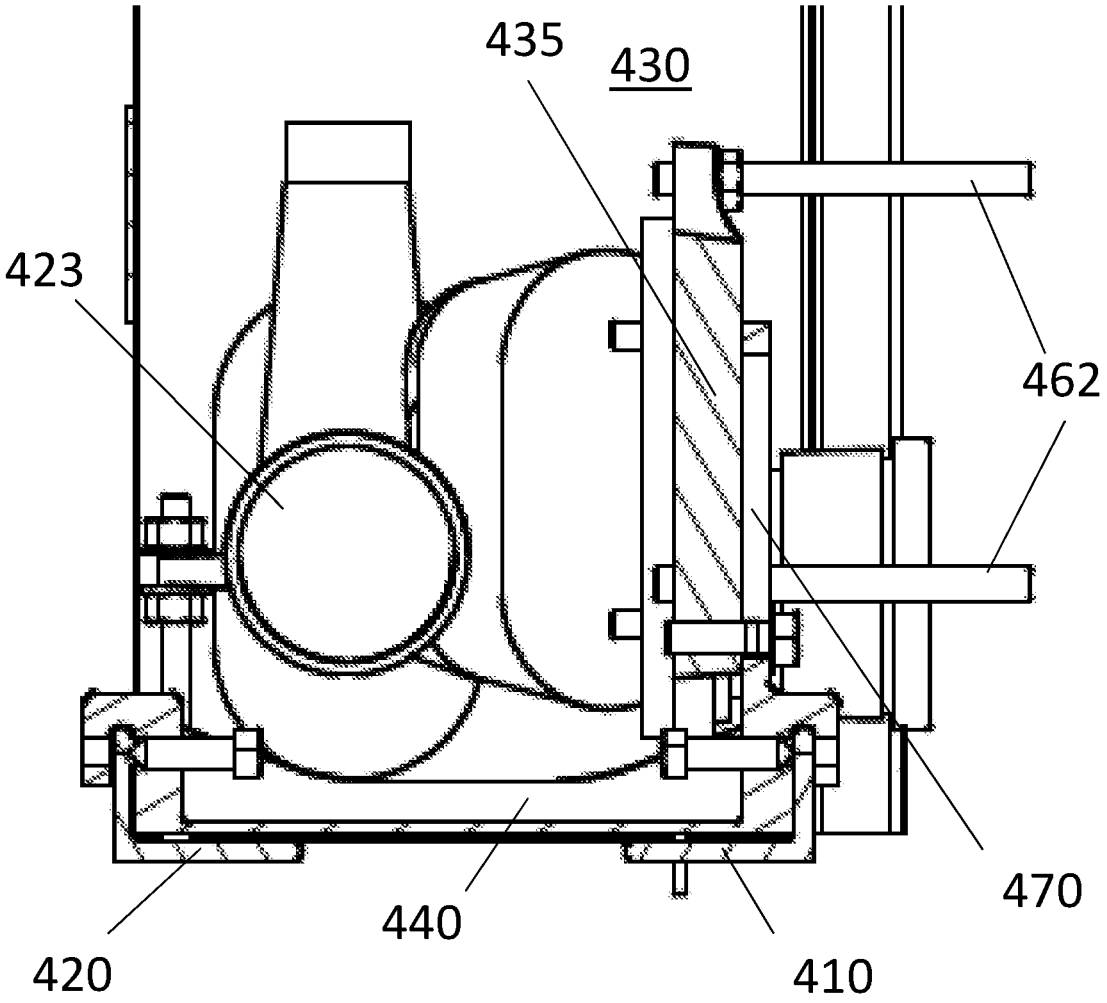
FIG. 4 depicts a side view of a carrier subassembly in accordance with the present invention.

FIG. 3A depicts an exemplary carrier subassembly (330) in accordance with the present invention. Carrier subassembly (330) may be attached to a first base rail (310) and a second base rail (320). FIG. 4 depicts a side view of the exemplary carrier subassembly (430) attached to a first base rail (410) and a second base rail (420). Carrier subassembly (330, 430) may include a carrier (335, 435) attached to a carrier mount (340, 440). An exemplary toilet carrier (335, 435) is shown in FIG. 3B. Carrier mount (340, 440) may have one or more frame posts (370, 470). Each frame post (370, 470) may have one or more apertures (375) that extends through frame post (370, 470). The one or more apertures (375) in each frame post (370, 470) may be used to attach a carrier (335, 435) to the carrier mount (340, 440). For example, one or more bolts extending from carrier (335, 435) may be inserted through one or more apertures (375) in frame post (370, 470) and secured in place with, for example, one or more nuts.

Figure 7A:
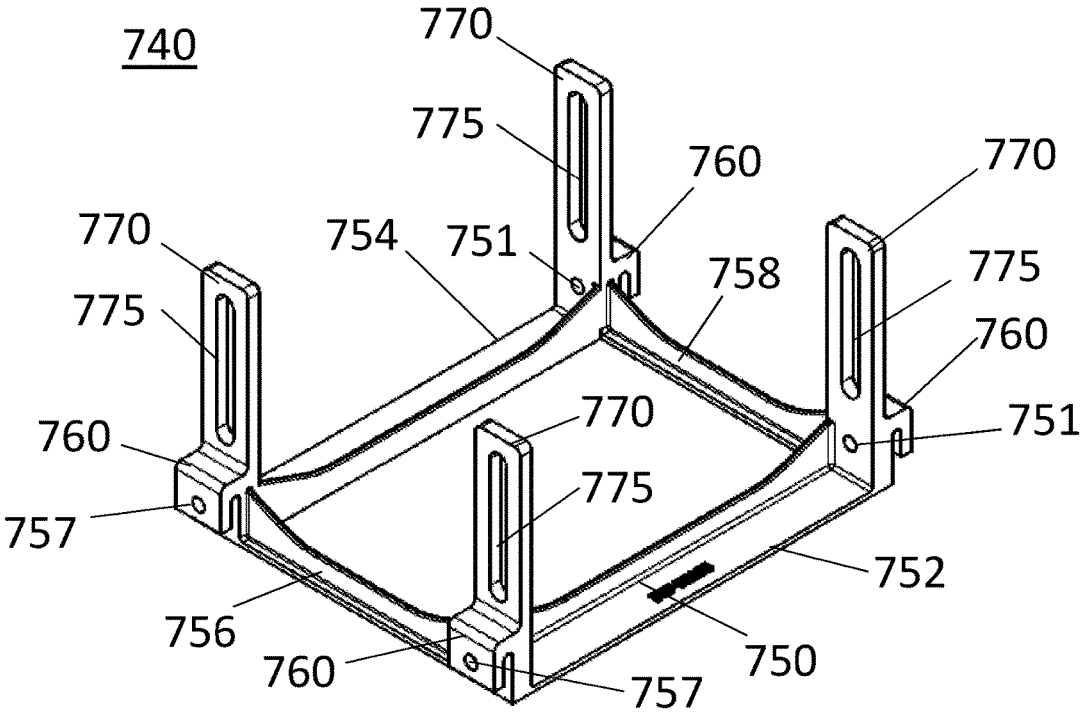
FIGS. 7A and 7B depict an alternate exemplary carrier mount in accordance with the present invention.
Figure 7B:
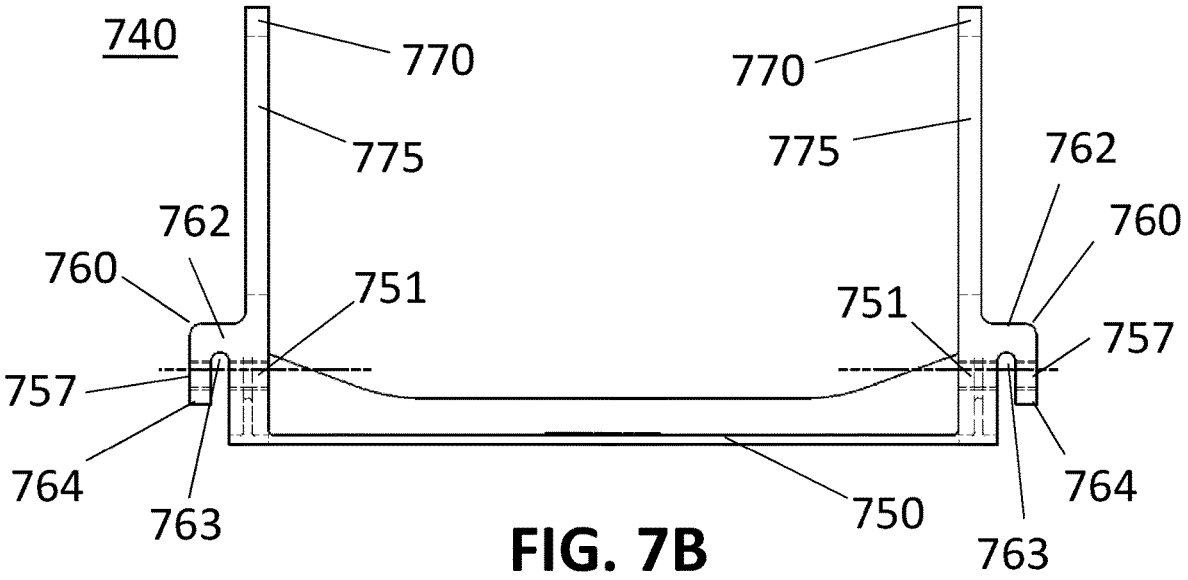

Mounting rods (362, 462) may extend from toilet carrier (335, 435) and may be used to support a toilet fixture (not shown). A waste water line (323, 423) may be attached to carrier (335, 435). Alternatively or additionally, as explained further below, the carrier assembly may include a sink carrier (795), an example of which is shown in FIG. 7F.

Figure 5A:
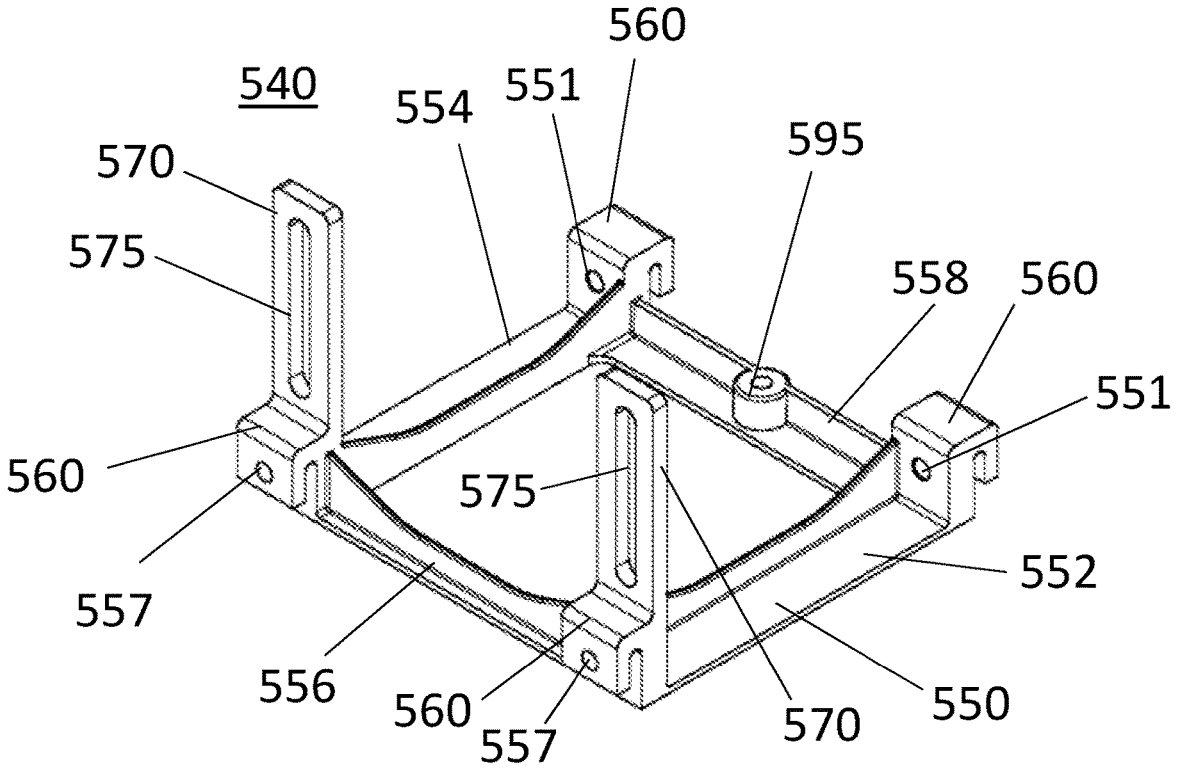
FIGS. 5A and 5B depict an exemplary carrier mount in accordance with the present invention.
Figure 5B:
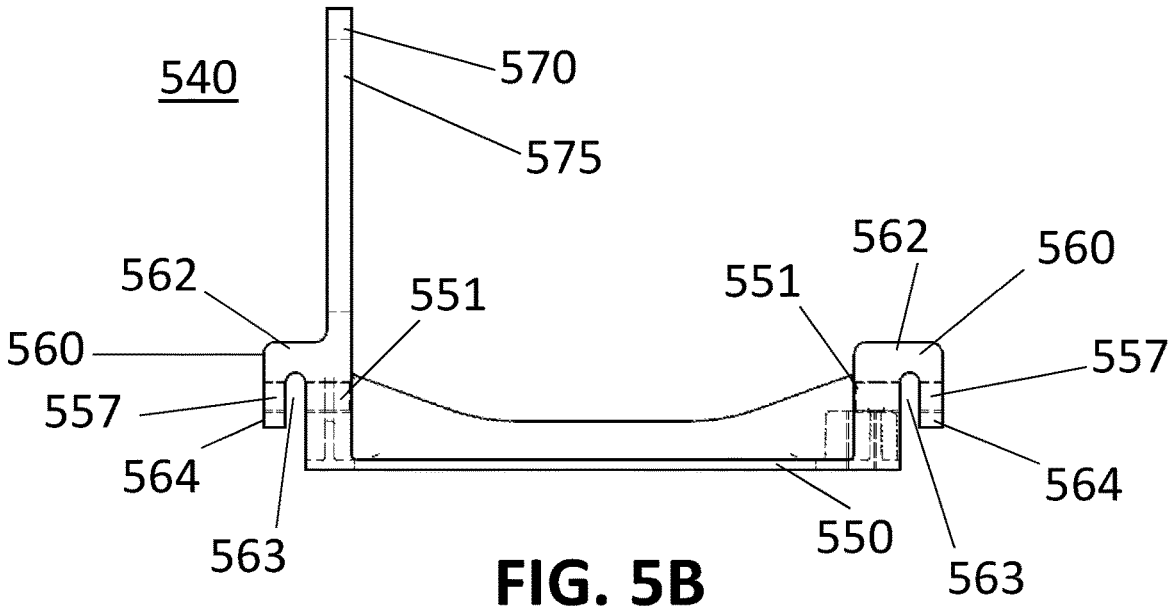
Figure 6A:
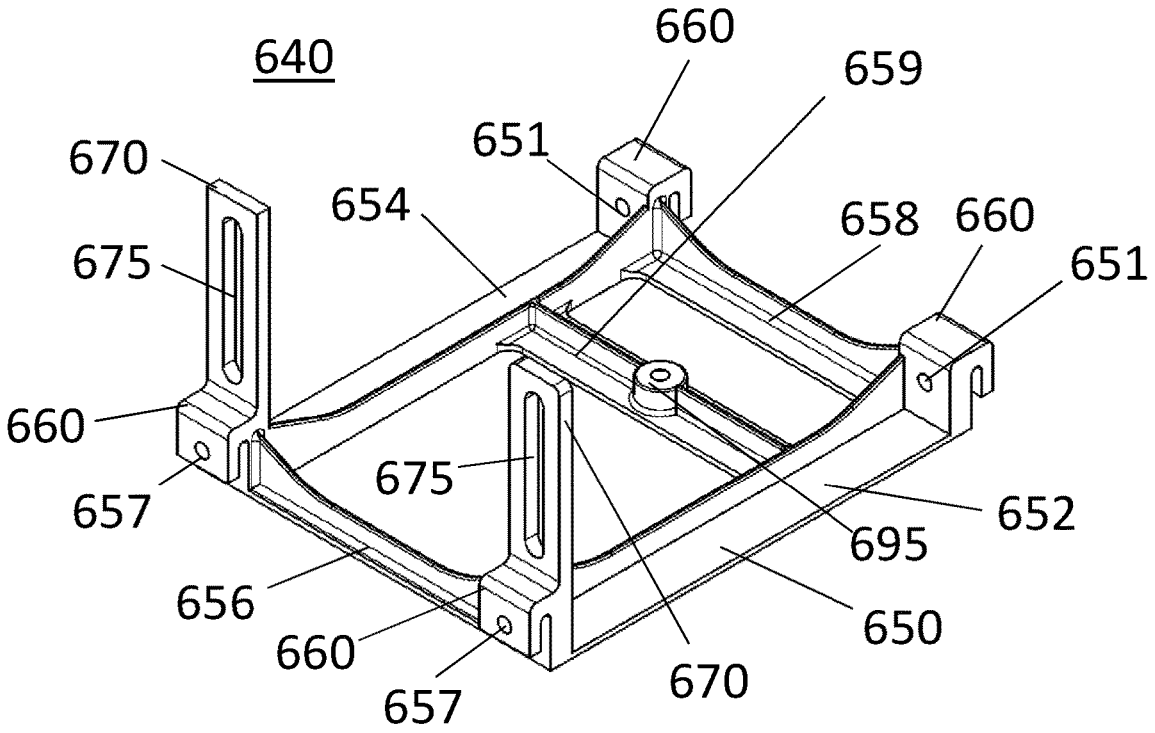
FIGS. 6A and 6B depict an alternate exemplary carrier mount in accordance with the present invention.
Figure 6B:
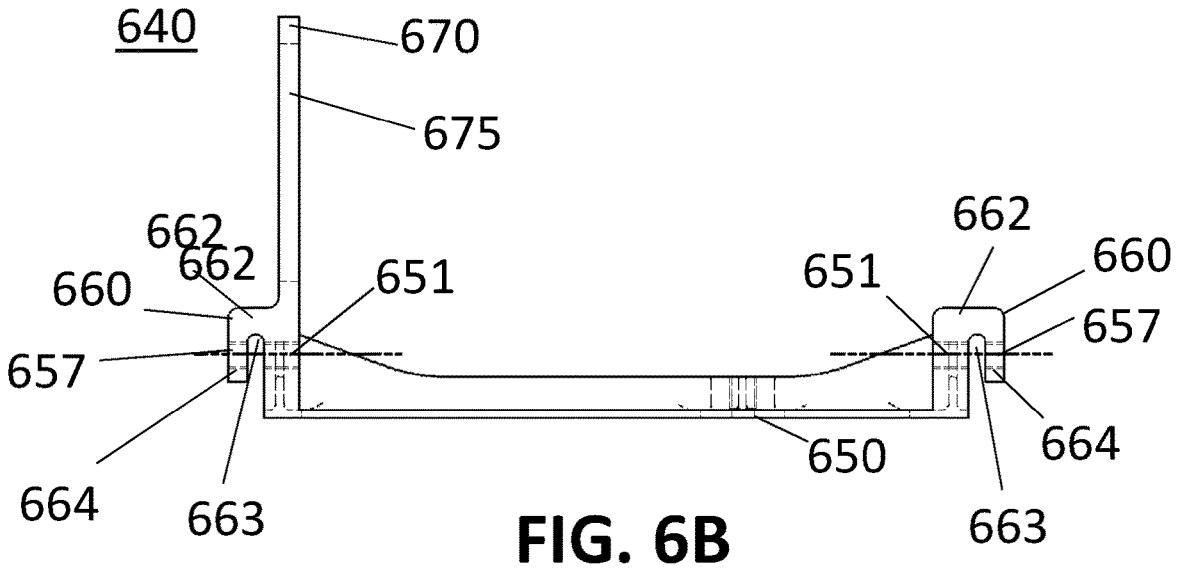

FIGS. 5A and 5B depict a perspective view and a side view, respectively, of first exemplary embodiment of a carrier mount (540) in accordance with the present invention. FIGS. 6A and 6B depict a perspective view and a side view, respectively, of a second exemplary embodiment of a carrier mount (640) in accordance with the present invention. FIGS. 7A and 7B depict a perspective view and a side view, respectively, of a third exemplary embodiment of a carrier mount (740) in accordance with the present invention. Each carrier mount is configured to attach to a carrier (or two carriers), each carrier having a unique configuration. However, certain elements are common to each of the exemplary carrier mounts (540, 640, 740). For example, each exemplary carrier mount (540, 640, 740) has a rectangular or substantially rectangular base (550, 650, 750) formed from two parallel struts (552 and 554, 652 and 654, 752 and 754) and two parallel cross braces (556 and 558, 656 and 658, and 756 and 758). Carrier mount (640) shown in FIGS. 6A and 6B has an additional cross brace (659). Also, as depicted in FIGS. 5A and 6A, one or more attachment members (595, 695) may be included on each cross brace (595, 695). The attachment members (595, 695) may be cylindrical and may have an aperture capable of receiving a carrier support.

Extending from one or more corners of the rectangular base (550, 650, 750) may be an angle iron (560, 660, 760) having a horizontal portion (562, 662, 762) and a vertical portion (564, 664, 764) descending from horizontal portion (562, 662, 762). A slot (563, 663, 763) formed between rectangular base (550, 650, 750) and angle iron (560, 660, 760) is preferably capable of receiving a vertical portion (218, 228, 248, 258, 268) of first base rail (110, 210, 310, 410, 510) and/or second base rail (120, 220, 320, 420, 520). Each angle iron (560, 660, 760) may have one or more apertures (557, 657, 757) extending there through. An aperture (551, 651, 751) may also be located at each corner of the rectangular base and aligned with the aperture (557, 657, 757) in angle iron (560, 660, 760). The internal surface of each aperture (551, 651, 751, 557, 657, 757) may be smooth or threaded.

As discussed above, each vertical portion (218, 228, 248, 258, 268) of first base rail (110, 210, 310, 410, 510) and/or second base rail (120, 220, 320, 420, 520) may also include one or more apertures (211, 221, 241, 251, 261). Each aperture (557, 657, 757) in each angle iron (560, 660, 760) may be aligned with an aperture (211, 221, 241, 251, 261) in vertical portion (218, 238, 248, 258, 268) of first base rail (110, 210, 310, 410, 510) and/or second base rail (120, 220, 320, 420, 520). When the apertures are aligned a bolt, screw or other joining member may be inserted through the apertures. The joining member may be secured in place with, for example, a nut, a pin, or by welding. In that way, a carrier mount may be secured to a first base rail and/or a second base rail. Alternatively, if the interior surface of one or more apertures (557, 657, 757) in one or more angle irons (560, 660, 760) is threaded, a screw may be threaded through each aperture until it impinges on a vertical portion (218, 238, 248, 258, 268) of first base rail (110, 210, 310, 410, 510) and/or second base rail (120, 220, 320, 420, 520).

Extending upward from each of one or more corners of rectangular base (550, 650, 750) of carrier mount (340, 440, 540, 640, 740) may be a frame post (370, 470, 570, 670, 770). Each frame post (370, 470, 570, 670, 770) may have one or more aperture (375, 575, 675, 775) that extends through frame post (370, 470, 570, 670, 770). The apertures (375, 575, 675, 775) in each frame post (370, 470, 570, 670, 770) may be used to attach a carrier (335, 435) to the carrier mount (340, 440, 540, 640, 740). For example, one or more bolts extending from carrier (335, 435, 535, 635, 735) may be inserted through slots (375, 575, 675, 775) or apertures in frame post (370, 470, 570, 670, 770) and secured in place with, for example, one or more nuts.

Figure 7C:
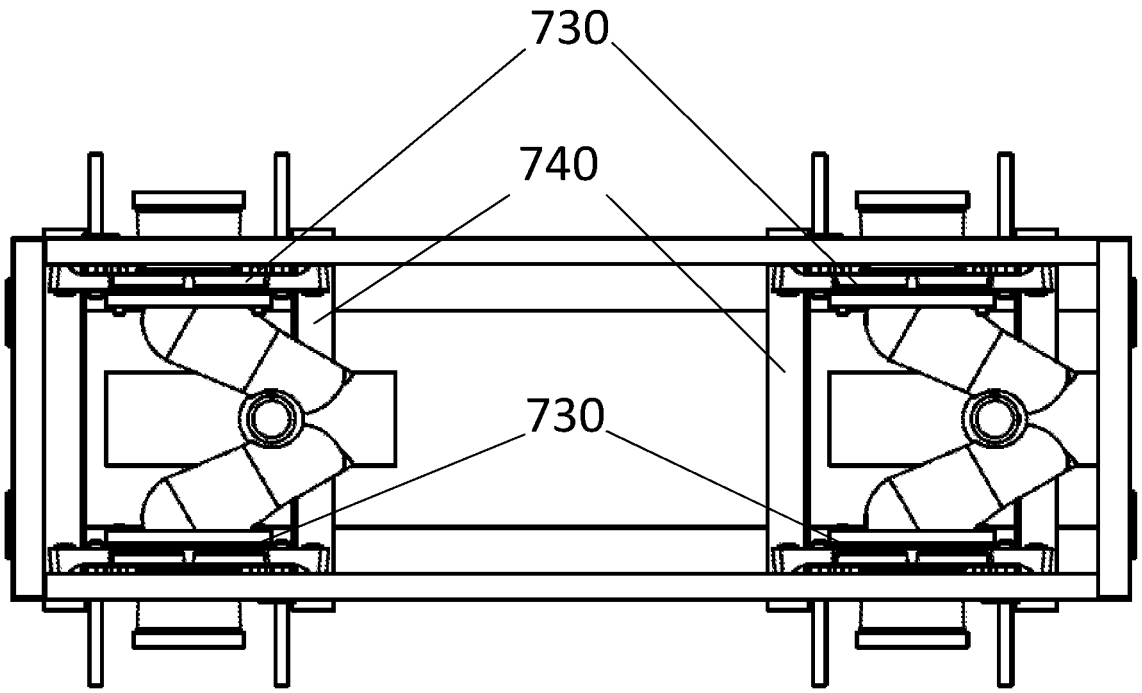
FIG. 7C depicts a top view of exemplary carrier subassemblies in accordance with the present invention.

FIG. 7C shows a plumbing assembly having two of the carrier mounts (740) depicted in FIGS. 7A and 7B. Two carriers (730), facing away from each other, may be attached to each carrier mount (740).

Figure 7D:
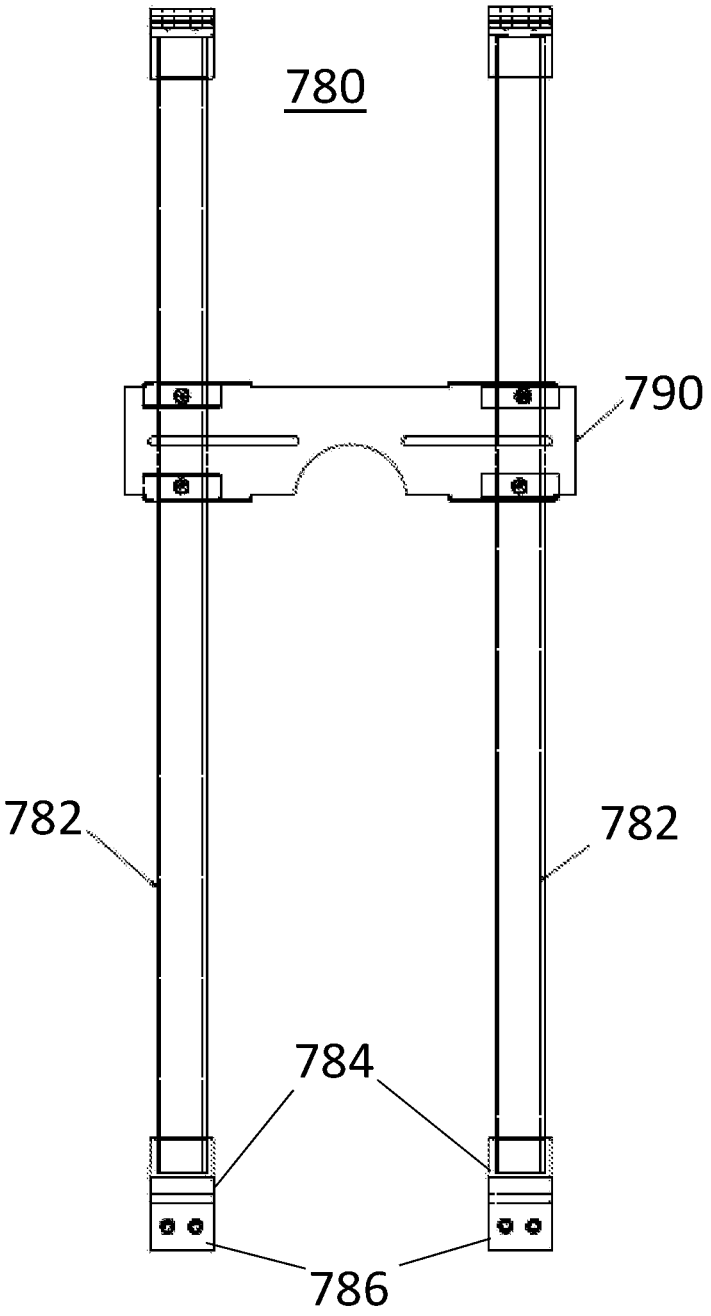
FIGS. 7D and 7E depict an exemplary urinal carrier subassembly in accordance with the present invention.
Figure 7E:
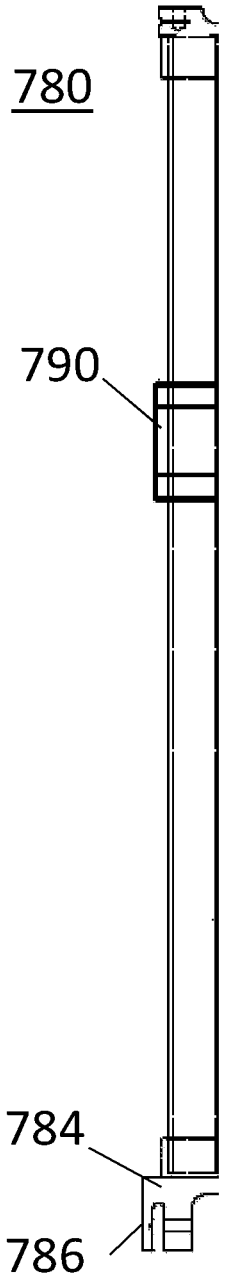
Figure 7F:
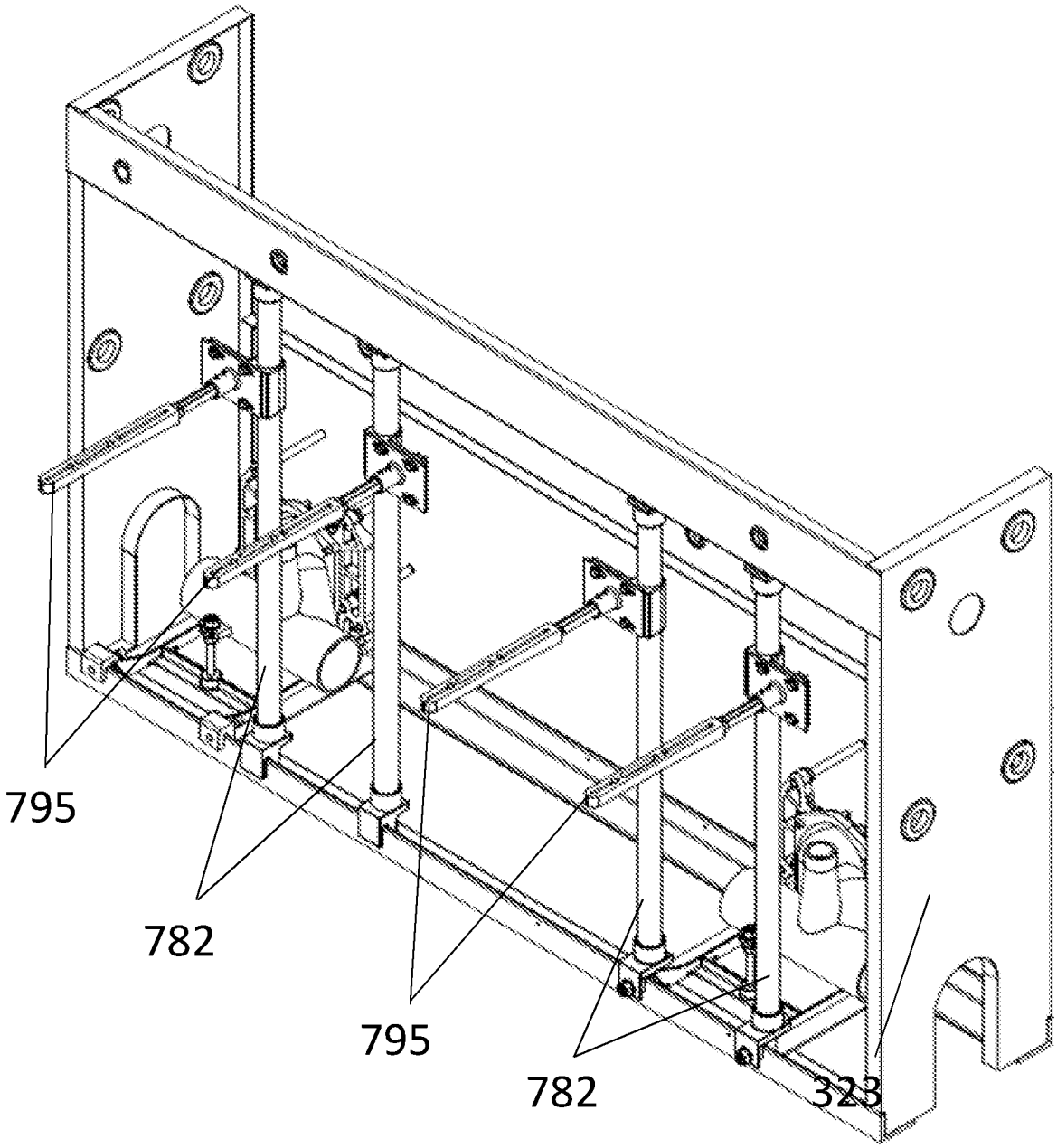
FIG. 7F depicts a plumbing assembly including sink carriers.

Plumbing assembly (100) may additionally or alternatively include carriers mounts for other types of fixtures. For example, in addition to or instead of the carriers described above, plumbing assembly (100) may include a carrier mount for a urinal and/or a carrier for a sink. FIGS. 7D and 7E depict a front view and side view, respectively, of an exemplary urinal carrier subassembly (780) in accordance with the present invention. Carrier subassembly (780) has two vertical struts (782). At the bottom end of each vertical strut (782) is a base (784) having an angle iron (786). Each angle iron (786) may be capable of being positioned over and joined to a vertical member of a first base rail and/or a second base rail as described above. Urinal carrier mount (790) may be connected to and span between vertical struts (782). FIG. 7F depicts sink carriers (795) connected to vertical struts (782).

Figures 8A, 8B:
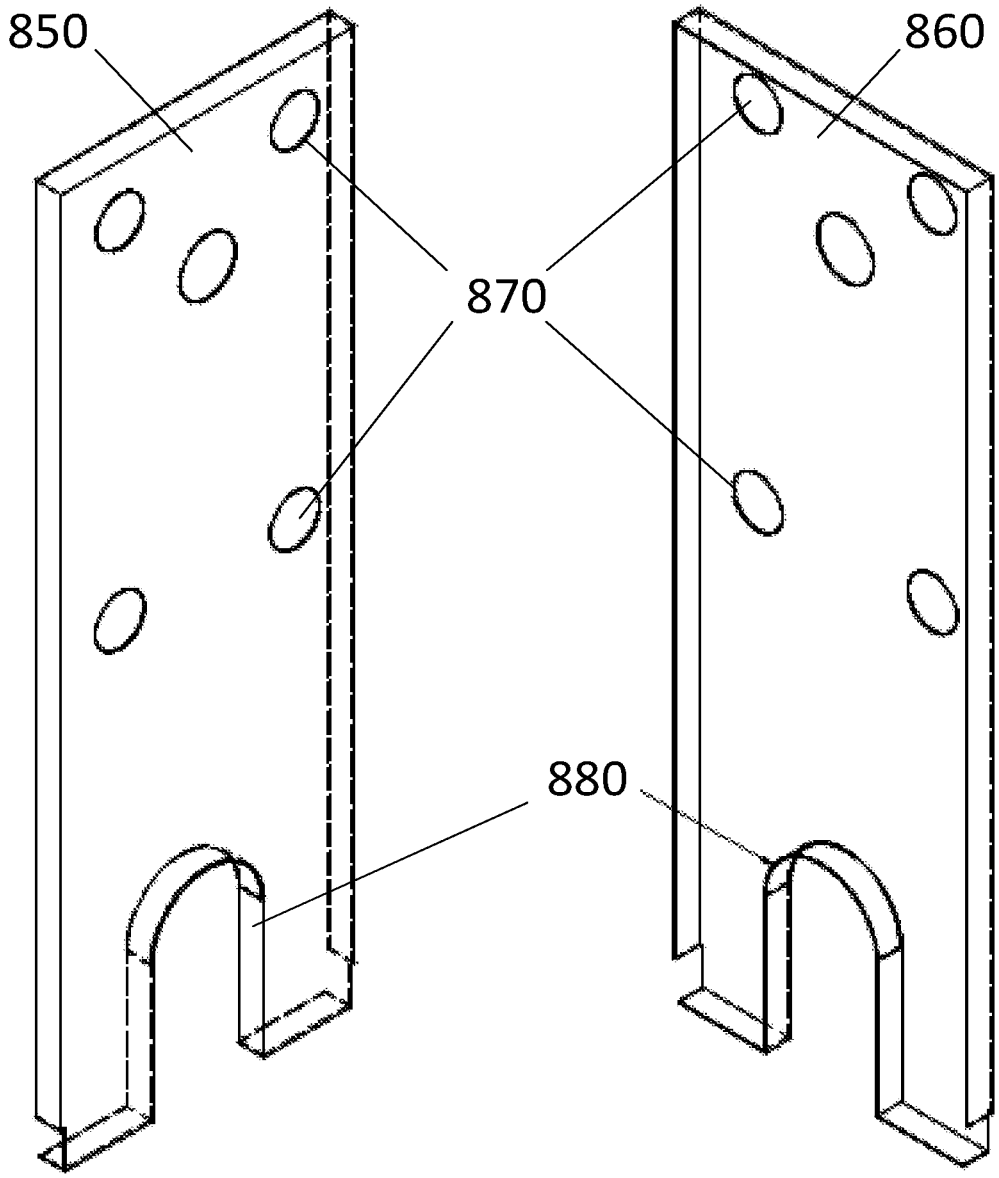
FIGS. 8A and 8B depict exemplary bulkheads in accordance with the present invention.
Figures 9A, 9B:
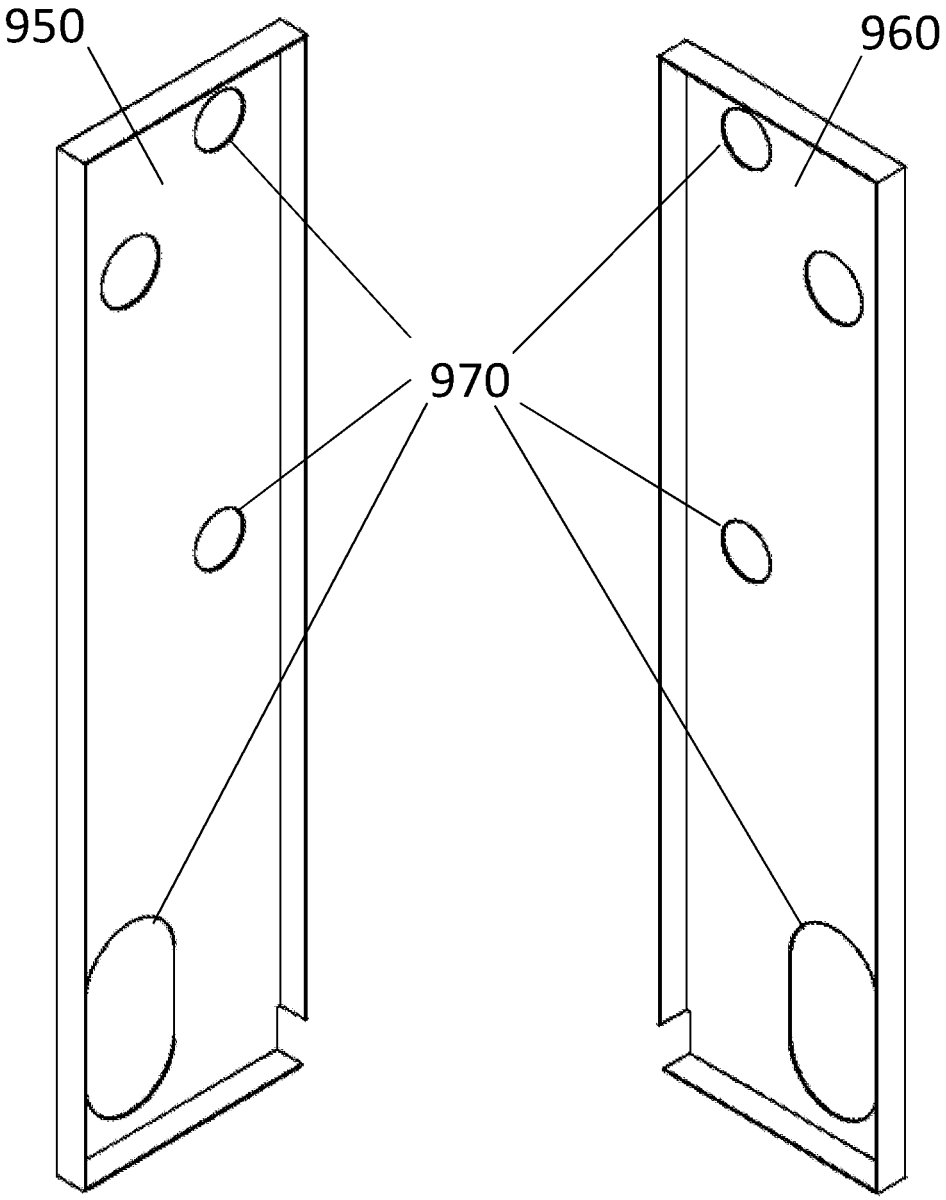
FIGS. 9A and 9B depict alternative exemplary bulkheads in accordance with the present invention.

FIGS. 8A and 8B depict an exemplary first bulkhead (850) and second bulkhead (860) that may be included in plumbing assembly (100). FIGS. 9A and 9B depict alternative exemplary first bulkhead (950) and second bulkhead (960). Plumbing lines (not shown) may extend up to or through apertures (870, 970) or cutouts (880) in first bulkhead (850, 950) and/or second bulkhead (860, 960) so that the plumbing lines may be easily connected to the rest of the plumbing system in the building in which plumbing assembly (100) is installed.

During construction, plumbing assembly (100) may be assembled in advance and transported to the construction site as a complete unit. Once in place at the construction site, plumbing assembly (100) may be secured to the floor using, for example, J-bolts attached to first base rail (110) and/or second base rail (120). A finished wall may then be constructed in front of plumbing assembly (100). Supports (390) extending from carrier (335, 435) may be capable of receiving a fixture, such as a toilet.

Figure 10:
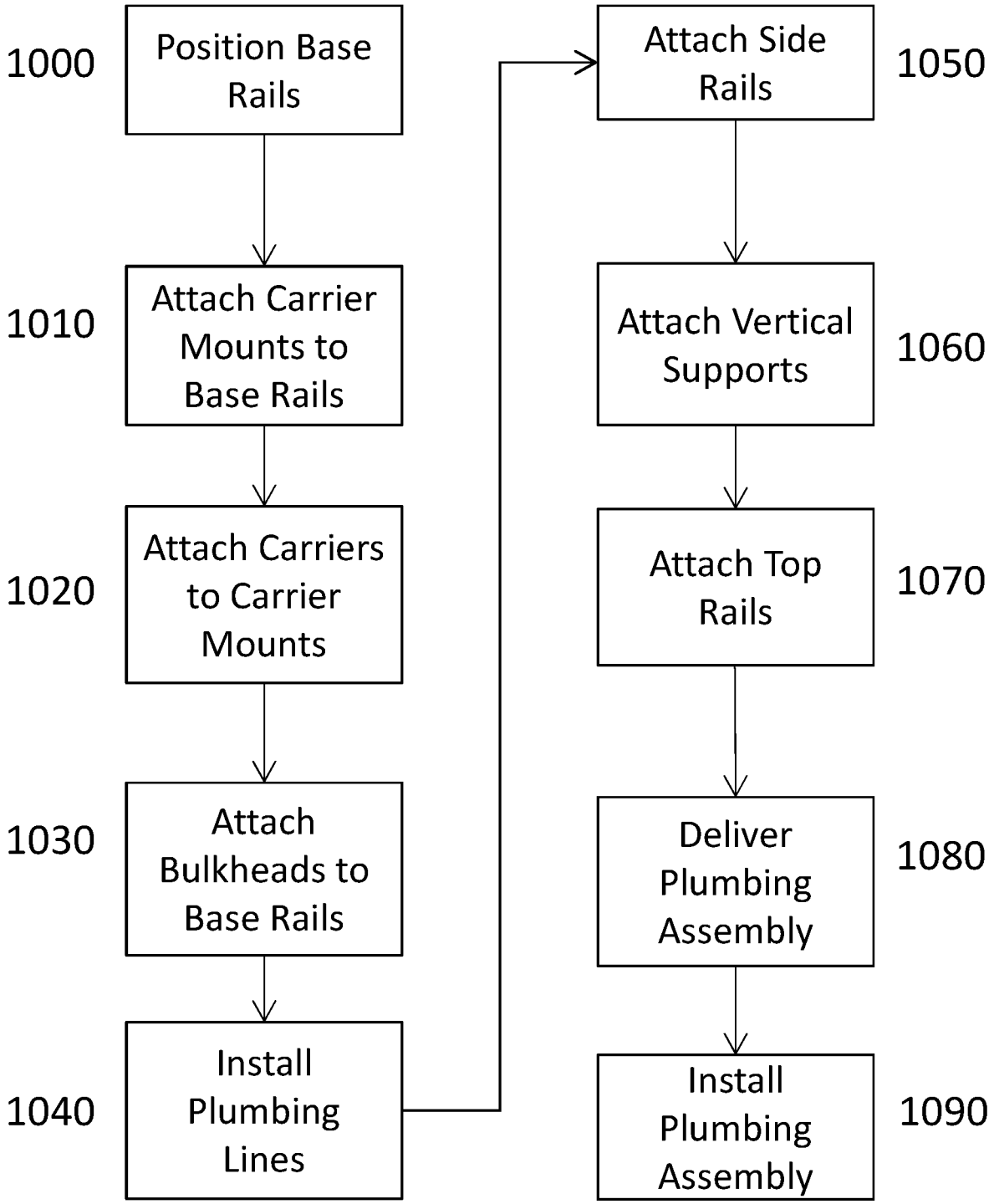
FIG. 10 is a flowchart depicting a method in accordance with the present invention.

FIG. 10 depicts a method of practicing the present invention. At Step (1000), base rails are positioned relative to each other. For example, a first base rail may be aligned parallel to a second base rail. At Step (1010), carrier mounts may be attached to the first base rail and second base rail. One or more angle irons that may be located at corners of each carrier mount may slide over vertical portions of the first base rail and/or second base rail. Apertures in the angle irons may be aligned with apertures or slots in first base rail and/or second base rail. Bolts, screws, or other joining members may be inserted through the apertures in the angle irons and/or the apertures or slots in the first base rail and/or second base rail to secure the carrier mounts to the base rails.

At Step (1020), one or two carriers may be attached to each carrier mount, depending on the configuration of the carrier mount and whether two fixtures are to be installed directly opposite each other (i.e., on opposite sides of the same wall).

At Step (1030), one or more bulkheads may be attached to the base rails.

At Step (1040), plumbing lines may be installed. The plumbing lines may include pipes for fresh water and pipes for waste water. The plumbing lines may extend up to and/or through one or more apertures or cutouts in the bulkheads.

At Steps (1050) and (1060), one or more side rails and one or more vertical supports may be installed. The one or more side rails may be attached to the one or more bulkheads. Vertical supports may be attached to one or more base rails and/or to one or more side rails.

At Step (1070), one or more top rails may be installed. The one or more top rails may be attached to the top edge of a first bulkhead and the top edge of a second bulkhead.

At Step (1080) the plumbing assembly (100) may be delivered to the job site. The plumbing assembly may be delivered, fully assembled to the room in which the plumbing assembly is to be installed. At Step (1090), the plumbing assembly (100) may be installed.

While the invention has been described in detail with reference to embodiments for the purposes of making a complete disclosure of the invention, such embodiments are merely exemplary and are not intended to be limiting or represent an exhaustive enumeration of all aspects of the invention. It will be apparent to those of ordinary skill in the art that numerous changes may be made in such details, and the invention is capable of being embodied in other forms, without departing from the spirit, essential characteristics, and principles of the invention. Also, the benefits, advantages, solutions to problems, and any elements that may allow or facilitate any benefit, advantage, or solution are not to be construed as critical, required, or essential to the invention. The scope of the invention is to be limited only by the appended claims.

What is claimed is:

1. A modular plumbing system, comprising:

a first base rail extending from a first end to a second end;

a second base rail extending from a first end to a second end, wherein said second base rail is aligned parallel to the first base rail;

a first carrier mount attached to the first base rail and second base rail;

a first carrier attached to the first carrier mount;

a first bulkhead attached to the first and second base rails; and a first top rail attached to the first and second bulkhead.

2. The modular plumbing system of claim 1, wherein said first carrier is a toilet carrier.

3. The modular plumbing system of claim 1, wherein said first carrier is a sink carrier.

4. The modular plumbing system of claim 1, wherein the first bulkhead is mounted to the first end of the first base rail and the first end of the second base rail.

5. The modular plumbing system of claim 4, wherein the second bulkhead is mounted to the second end of the first base rail and the second end of the second base rail.

6. The modular plumbing system of claim 1, wherein the first base rail and the second base rail have an L-shaped cross-section.

7. The modular plumbing system of claim 1, wherein the first base rail comprises one or more apertures.

8. The modular plumbing system of claim 1, further comprising:

a second carrier mount attached to the first base rail and second base rail; and a second carrier attached to the second carrier mount.

9. The modular plumbing system of claim 8, wherein said second carrier is a toilet carrier.

10. The modular plumbing system of claim 8, wherein said second carrier is a sink carrier.

11. The modular plumbing system of claim 8, wherein the first bulkhead is mounted to the first end of the first base rail and the first end of the second base rail.

12. The modular plumbing system of claim 11, wherein the second bulkhead is mounted to the second end of the first base rail and the second end of the second base rail.

13. The modular plumbing system of claim 8, wherein the first base rail and the second base rail have an L-shaped cross-section.

14. The modular plumbing system of claim 8, wherein the first base rail comprises one or more apertures.

15. The modular plumbing system of claim 1, further comprising a second carrier attached to the first carrier mount.

16. The modular plumbing system of claim 15, wherein said second carrier is a toilet carrier.

17. The modular plumbing system of claim 15, wherein said second carrier is a sink carrier.

18. The modular plumbing system of claim 15, wherein the first bulkhead is mounted to the first end of the first base rail and the first end of the second base rail.

19. The modular plumbing system of claim 18, wherein the second bulkhead is mounted to the second end of the first base rail and the second end of the second base rail.

20. The modular plumbing system of claim 15, wherein the first base rail and the second base rail have an L-shaped cross-section.

* * * * *